US009905187B2

(12) United States Patent
Hwang et al.

(10) Patent No.: US 9,905,187 B2
(45) Date of Patent: Feb. 27, 2018

(54) METHOD OF DRIVING DISPLAY PANEL AND DISPLAY APPARATUS FOR PERFORMING THE SAME

(71) Applicant: Samsung Display Co., Ltd., Yongin, Gyeonggi-Do (KR)

(72) Inventors: Jong-Hak Hwang, Yongin-si (KR); Wan-Soon Im, Cheonan-si (KR); Hyung-June Kim, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 184 days.

(21) Appl. No.: 14/539,514

(22) Filed: Nov. 12, 2014

(65) Prior Publication Data

US 2015/0364104 A1 Dec. 17, 2015

(30) Foreign Application Priority Data

Jun. 17, 2014 (KR) ..... 10-2014-0073697

(51) Int. Cl.
*G09G 3/36* (2006.01)

(52) U.S. Cl.
CPC ..... *G09G 3/3696* (2013.01); *G09G 3/3614* (2013.01); *G09G 3/3688* (2013.01); *G09G 3/3607* (2013.01); *G09G 2320/0204* (2013.01)

(58) Field of Classification Search
CPC ..... G09G 3/3616
See application file for complete search history.

(56) References Cited

U.S. PATENT DOCUMENTS 6,496,172 B1 * 12/2002 Hirakata ..... G09G 3/3614 345/100
7,084,848 B2 8/2006 Senda et al.
8,111,366 B2 2/2012 Kim
8,362,975 B2 1/2013 Uehara
8,624,800 B2 1/2014 Yang et al.
2004/0246220 A1 * 12/2004 Cheon ..... G09G 3/3648 345/89
2006/0028495 A1 2/2006 Phan
2006/0202927 A1 * 9/2006 Lee ..... G02F 1/1368 345/88
2007/0262938 A1 * 11/2007 Kim ..... G02F 1/13624 345/92
2008/0068524 A1 3/2008 Kim
(Continued)

FOREIGN PATENT DOCUMENTS

KR 2001-0081677 A 8/2001
KR 10-2011-0001887 A 1/2011
(Continued)

*Primary Examiner* — Dorothy Harris
(74) *Attorney, Agent, or Firm* — H.C. Park & Associates, PLC

(57) ABSTRACT

A method of driving a display panel comprises applying a first set of pixel voltages including a positive pixel voltage (+) and a negative pixel voltage (−) to subpixels of a display panel in an N-th frame, applying a second set of pixel voltages having polarities opposite to polarities of the first set of the pixel voltages to the subpixels of the display panel in an (N+1)-th frame and applying compensating values which are varied for respective data lines of the display panel. N is a natural number. A corresponding display panel is also disclosed.

19 Claims, 10 Drawing Sheets

| | C1 | C2 | C3 | C4 | C5 | C6 | C7 | C8 | C9 | C10 | C11 | C12 | C13 | C14 | C15 | C16 | C17 | C18 | C19 | C20 | C21 | C22 | C23 | C24 |
|---|---|---|---|---|---|---|---|---|---|---|---|---|---|---|---|---|---|---|---|---|---|---|---|---|
| POLARITY OF N-TH FRAME | R + | G + | B − | W + | R − | G − | B + | W − | R + | G + | B − | W + | R − | G − | B + | W − | R + | G + | B − | W + | R − | G − | B + | W − |
| IMAGE OF N-TH FRAME | + | + | − | + | − | − | + | − | + | + | − | + | − | − | + | − | + | + | − | + | − | − | + | − |
| POLARITY OF (N+1)-TH FRAME | R − | G − | B + | W − | R + | G + | B − | W + | R − | G − | B + | W − | R + | G + | B − | W + | R − | G − | B + | W − | R + | G + | B − | W + |
| DISPLACEMENT OF IMAGE OF N-TH FRAME | ← 2 SUB PIXELS → | | + | + | − | + | − | − | + | − | + | + | − | + | − | − | + | − | + | + | − | + | − | − |

(56) References Cited

U.S. PATENT DOCUMENTS

| | | | | |
|---|---|---|---|---|
| 2009/0040243 | A1* | 2/2009 | Hisada | G09G 3/3614 345/690 |
| 2010/0141630 | A1 | 6/2010 | Kimura | |
| 2010/0328360 | A1* | 12/2010 | Miyashita | G09G 3/3614 345/690 |
| 2011/0221727 | A1* | 9/2011 | Kim | G09G 3/3614 345/209 |
| 2011/0249046 | A1* | 10/2011 | Lee | G09G 3/3688 345/691 |
| 2012/0139970 | A1 | 6/2012 | Kim | |
| 2012/0194573 | A1* | 8/2012 | Yamashita | G09G 3/3614 345/690 |
| 2013/0016137 | A1* | 1/2013 | Nakagawa | G09G 3/3614 345/690 |
| 2013/0241960 | A1* | 9/2013 | Xu | G09G 3/3413 345/690 |

FOREIGN PATENT DOCUMENTS

| | | | |
|---|---|---|---|
| KR | 10-2015-0069411 | A | 6/2015 |
| KR | 10-2015-0069726 | A | 6/2015 |
| KR | 10-2015-0069748 | A | 6/2015 |
| KR | 10-2015-0121391 | A | 10/2015 |

* cited by examiner

METHOD OF DRIVING DISPLAY PANEL AND DISPLAY APPARATUS FOR PERFORMING THE SAME

CLAIM OF PRIORITY

This application claims priority under 35 U.S.C. § 119 to Korean Patent Application No. 10-2014-0073697, filed on Jun. 17, 2014 in the Korean Intellectual Property Office KIPO, the contents of which are herein incorporated by reference in their entireties.

BACKGROUND OF THE INVENTION

Field of the Invention

The present invention relates to a method of driving a display panel and a display apparatus for performing the method. More particularly, the present invention relates to a method of driving a display panel improving a display quality and a display apparatus for performing the method.

Description of the Related Art

Generally, a liquid crystal display ("LCD") apparatus comprises a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, transmittance of a light passing through the liquid crystal layer may be adjusted so that a desired image may be displayed.

A grayscale of a pixel is determined by the difference between a pixel voltage applied to the pixel electrode and a common voltage applied to the common electrode. When the pixel electrode has a single polarity with respect to the common voltage, a residual DC voltage may be accumulated at the common electrode. Due to the accumulated residual DC voltage, the display quality of the display panel may be deteriorated.

To prevent the residual DC voltage from being accumulated, a positive pixel voltage having a positive polarity with respect to the common voltage and a negative pixel voltage having a negative polarity with respect to the common voltage may be alternately applied to data lines of the display panel, and the polarity of the pixel voltage may be inverted in every frame. The above-explained driving method is called a column inversion method. When the display panel is driven in the column inversion method and a pattern is displaced in a specific direction on the display panel, a vertical line defect may be generated due to a polarity characteristic of the pixel voltage representing the displacing pattern. Thus, the display quality of the display panel may be deteriorated.

SUMMARY OF THE INVENTION

The present invention provides a method of driving a display panel so as to improve a display quality of the display panel.

The present invention also provides a display apparatus for performing the method.

In an exemplary embodiment of a method of driving a display apparatus according to the present invention, the method comprises applying a first set of pixel voltages including a positive pixel voltage (+) and a negative pixel voltage (−) to subpixels of a display panel in an N-th frame, applying a second set of pixel voltages having polarities opposite to polarities of the first set of the pixel voltages to the subpixels of the display panel in an (N+1)-th frame, and applying compensating values which are varied for respective data lines of the display panel. N is a natural number.

In an exemplary embodiment, a first color subpixel, a second color subpixel, a third color subpixel and a fourth color subpixel may be sequentially and repetitively disposed in a first pixel row of the display panel.

In an exemplary embodiment, the third color subpixel, the fourth color subpixel, the first color subpixel and the second color subpixel may be sequentially and repetitively disposed in a second pixel row of the display panel.

In an exemplary embodiment, the first color subpixel, the second color subpixel and the third color subpixel may be a red subpixel, a green subpixel and a blue subpixel.

In an exemplary embodiment, the fourth color subpixel may be a white subpixel, respectively.

In an exemplary embodiment, polarities of the pixel voltages corresponding to first to eighth pixel columns of the display panel may be sequentially +, +, −, +, −, −, +, − in the N-th frame, or the polarities of the pixel voltages corresponding to the first to eighth pixel columns of the display panel may be sequentially −, −, +, −, +, +, −, + in the (N+1)-th frame.

In an exemplary embodiment, a negative compensating value may be applied to the pixel voltages of the third and sixth pixel columns to decrease luminance, and a positive compensating value may be applied to the pixel voltages of the second and seventh pixel columns to increase the luminance.

In an exemplary embodiment, when an image on the display panel in the N-th frame displaces in the (N+1)-th frame by two subpixels, a negative compensating value may be applied to the pixel voltages of the third and sixth pixel columns to decrease luminance in the (N+1)-th frame and a positive compensating value may be applied to the pixel voltages of the second and seventh pixel columns to increase the luminance in the (N+1)-th frame.

In an exemplary embodiment, when an image on the display panel in the N-th frame displaces in the (N+1)-th frame by four subpixels, a negative compensating value may be applied to the pixel voltages of the third, fifth, sixth and eighth pixel columns to decrease luminance in the (N+1)-th frame and a positive compensating value may be applied to the pixel voltages of the first, second, fourth and seventh pixel columns to increase the luminance in the (N+1)-th frame.

In an exemplary embodiment, polarities of the pixel voltages corresponding to first to eighth pixel columns of the display panel may be sequentially +, −, +, −, −, +, −, + in the N-th frame, or the polarities of the pixel voltages corresponding to the first to eighth pixel columns of the display panel may be sequentially −, +, −, +, +, −, +, − in the (N+1)-th frame.

In an exemplary embodiment, a negative compensating value may be applied to the pixel voltages of the second and fifth pixel columns to decrease luminance, and a positive compensating value may be applied to the pixel voltages of the first and sixth pixel columns to increase the luminance.

In an exemplary embodiment, when an image on the display panel in the N-th frame displaces in the (N+1)-th frame by two subpixels, a negative compensating value may be applied to the pixel voltages of the second and fifth pixel columns to decrease luminance in the (N+1)-th frame and a positive compensating value may be applied to the pixel voltages of the first and sixth pixel columns to increase the luminance in the (N+1)-th frame.

In an exemplary embodiment, when an image on the display panel in the N-th frame displaces in the (N+1)-th frame by four subpixels, a negative compensating value may be applied to the pixel voltages of the second, fourth, fifth and seventh pixel columns to decrease luminance in the (N+1)-th frame and a positive compensating value may be applied to the pixel voltages of the first, third, sixth and eighth pixel columns to increase the luminance in the (N+1)-th frame.

In an exemplary embodiment, when an image on the display panel in the N-th frame displaces in the (N+1)-th frame by X subpixels in a first direction, a first polarity of a first subpixel of the (N+1)-th frame and a second polarity of a second subpixel in the image of the N-th frame may be determined. The second subpixel may be spaced apart from the first subpixel by X subpixels in a second direction opposite to the first direction. When both of the first polarity and the second polarity are positive (+), a negative compensating value may be applied to the pixel voltage of the first pixel to decrease luminance in the (N+1)-th frame. When both of the first polarity and the second polarity are negative (−), a positive compensating value may be applied to the pixel voltage of the first pixel to increase the luminance in the (N+1)-th frame. X is a natural number.

In an exemplary embodiment of a display apparatus according to the present invention, the display apparatus comprises a display panel and a data driver. The display panel comprises a plurality of subpixels. The data driver is configured to apply a first set of pixel voltages including a positive pixel voltage (+) and a negative pixel voltage (−) to the subpixels of the display panel in an N-th frame, to apply a second set of pixel voltages having polarities opposite to polarities of the first set of the pixel voltages to the subpixels of the display panel in an (N+1)-th frame, and to apply compensating values which are varied for respective data lines of the display panel.

In an exemplary embodiment, a first color subpixel, a second color subpixel, a third color subpixel and a fourth color subpixel may be sequentially and repetitively disposed in a first pixel row of the display panel.

In an exemplary embodiment, polarities of the pixel voltages corresponding to first to eighth pixel columns of the display panel may be sequentially +, +, −, +, −, −, +, − in the N-th frame, or the polarities of the pixel voltages corresponding to the first to eighth pixel columns of the display panel may be sequentially −, −, +, −, +, +, −, + in the (N+1)-th frame.

In an exemplary embodiment, a negative compensating value may be applied to the pixel voltages of the third and sixth pixel columns to decrease luminance, and a positive compensating value may be applied to the pixel voltages of the second and seventh pixel columns to increase the luminance.

In an exemplary embodiment, polarities of the pixel voltages corresponding to first to eighth pixel columns of the display panel may be sequentially +, −, +, −, −, +, −, + in the N-th frame, or the polarities of the pixel voltages corresponding to the first to eighth pixel columns of the display panel may be sequentially −, +, −, +, +, −, +, − in the (N+1)-th frame.

In an exemplary embodiment, a negative compensating value may be applied to the pixel voltages of the second and fifth pixel columns to decrease luminance, and a positive compensating value may be applied to the pixel voltages of the first and sixth pixel columns to increase the luminance.

According to the method of driving the display panel and the display apparatus for performing the method, compensating values are varied for the respective data lines in the display panel which is driven in the inversion driving method. Thus, when an image displaces on the display panel in a direction, the vertical line defect may be prevented so that the display quality of the display panel may be improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, the present invention will be explained in detail with reference to the accompanying drawings.

Figure 1:
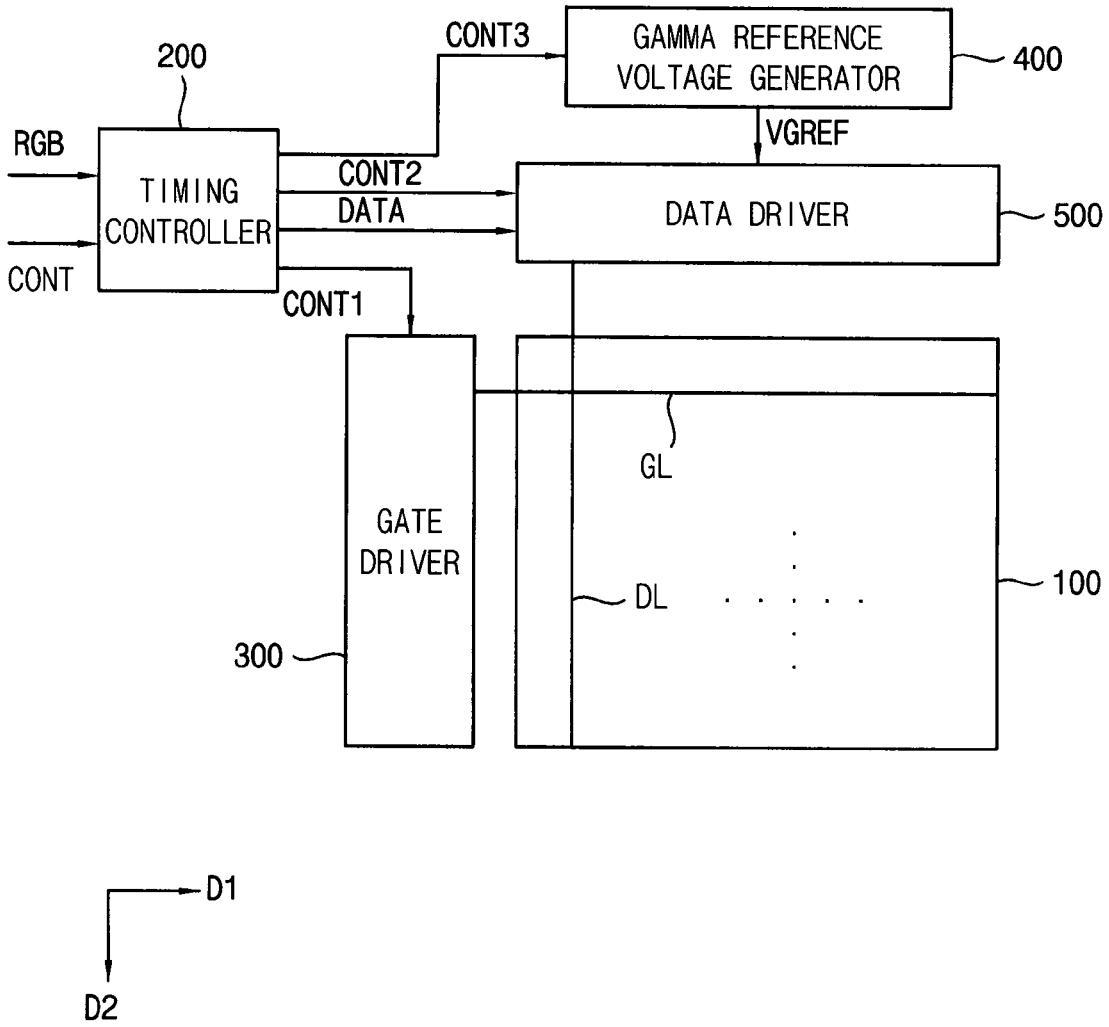
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, the display apparatus comprises a display panel 100 and a panel driver. The panel driver includes a timing controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines GL, a plurality of data lines DL and a plurality of subpixels connected to the gate lines GL and the data lines DL. The gate lines GL extend in a first direction D1 and the data lines DL extend in a second direction D2 crossing the first direction D1.

Each subpixel includes a switching element (not shown), a liquid crystal capacitor (not shown) and a storage capacitor (not shown). The liquid crystal capacitor and the storage capacitor are electrically connected to the switching element. The subpixels may be disposed in a matrix form. Some of the subpixels may form a pixel. For example, a first color subpixel, a second color subpixel, a third color subpixel and a fourth color subpixel may form a pixel.

A pixel structure of the display panel 100 will later be explained in detail with reference to FIG. 2.

The timing controller 200 receives input image data RGB and an input control signal CONT from an external apparatus (not shown). The input image data may include red image data R, green image data G and blue image data B. The input control signal CONT may include a master clock signal and a data enable signal. The input control signal CONT may also include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal. The second control signal CONT2 may further include an inversion control signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or it may be connected to the display panel 100 as a tape carrier package (TCP) type. Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200 or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages of an analog type using the gamma reference voltages VGREF. The data driver 500 sequentially outputs the data voltages to the data lines DL.

The data driver 500 may be directly mounted on the display panel 100, or it may be connected to the display panel 100 in a TCP type. Alternatively, the data driver 500 may be integrated on the peripheral region of the display panel 100.

Figure 2:
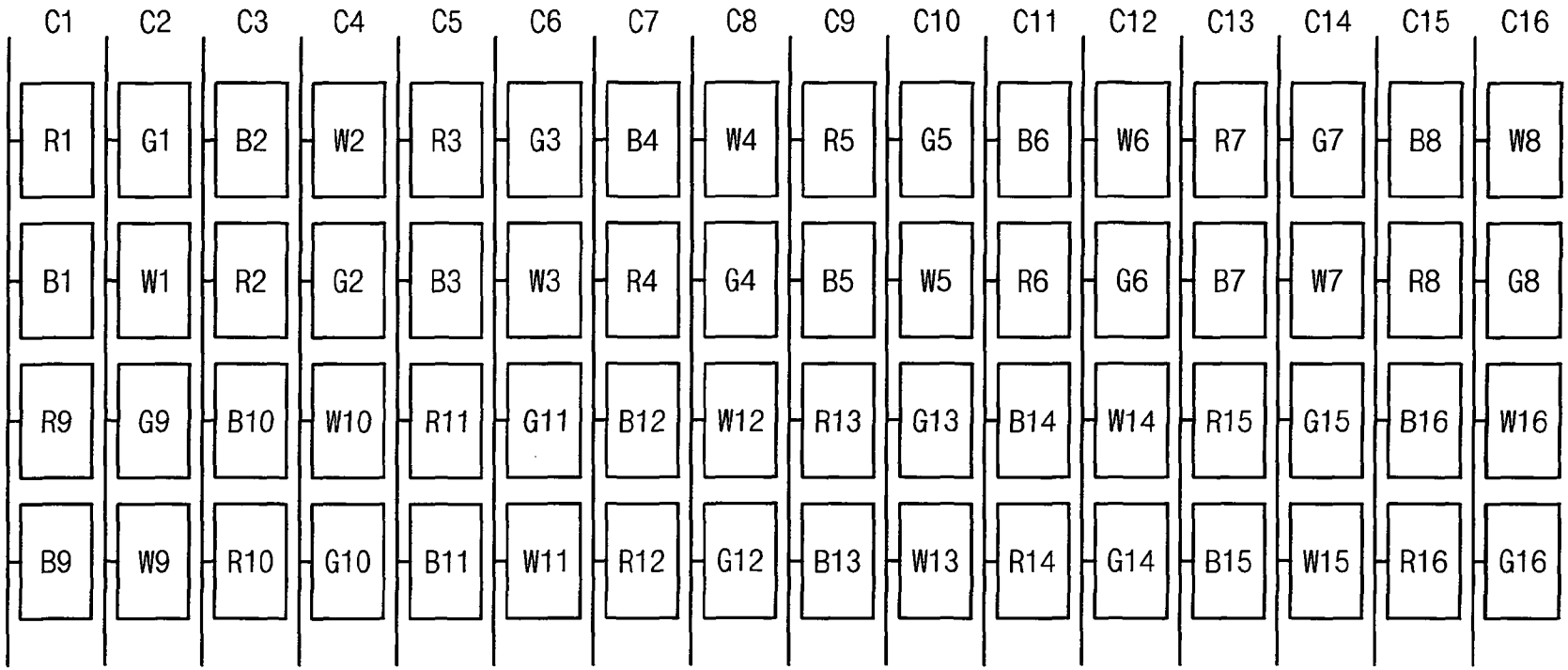
FIG. 2 is a plan view illustrating a pixel structure of a display panel of FIG. 1.

FIG. 2 is a plan view illustrating a pixel structure of the display panel of FIG. 1.

Referring to FIGS. 1 and 2, the display panel 100 includes a plurality of subpixels. The subpixels form a pixel row in the first direction D1 and a pixel column in the second direction D2.

In a first pixel row of the display panel 100, a first color subpixel R, a second color subpixel G, a third color subpixel B and a fourth color subpixel W are sequentially and repetitively disposed. In a second pixel row of the display panel 100, the third color subpixel B, the fourth color subpixel W, the first color subpixel R and the second color subpixel G are sequentially and repetitively disposed.

In a third pixel row of the display panel 100, the first color subpixel R, the second color subpixel G, the third color subpixel B and the fourth color subpixel W are sequentially and repetitively disposed. In a fourth pixel row of the display panel 100, the third color subpixel B, the fourth color subpixel W, the first color subpixel R and the second color subpixel G are sequentially and repetitively disposed.

A first color subpixel R1 in a first row and a first column, a second color subpixel G1 in the first row and a second column, a third color subpixel B1 in a second row and the first column, and a fourth color subpixel W1 in the second row and the second column may form a first pixel. A third color subpixel B2 in the first row and a third column, a fourth color subpixel W2 in the first row and a fourth column, a first color subpixel R2 in the second row and the third column, and a second color subpixel G2 in the second row and the fourth column may form a second pixel.

The first color subpixel R, the second color subpixel G and the third color subpixel B may be respectively a red subpixel, a green subpixel and a blue subpixel.

The fourth color subpixel W may be a white subpixel. Alternatively, the fourth color subpixel W may be one of a cyan subpixel, a magenta subpixel and a yellow subpixel.

The timing controller 200 generates the pixel voltages of the first color subpixel R, the second color subpixel G, the third color subpixel B and the fourth color subpixel W based on the red image data R, the green image data G and the blue image data B.

For example, the subpixel may have a rectangular shape. A longer side of the subpixel may have a length about twice the length of a shorter side of the subpixel.

Figure 3A:
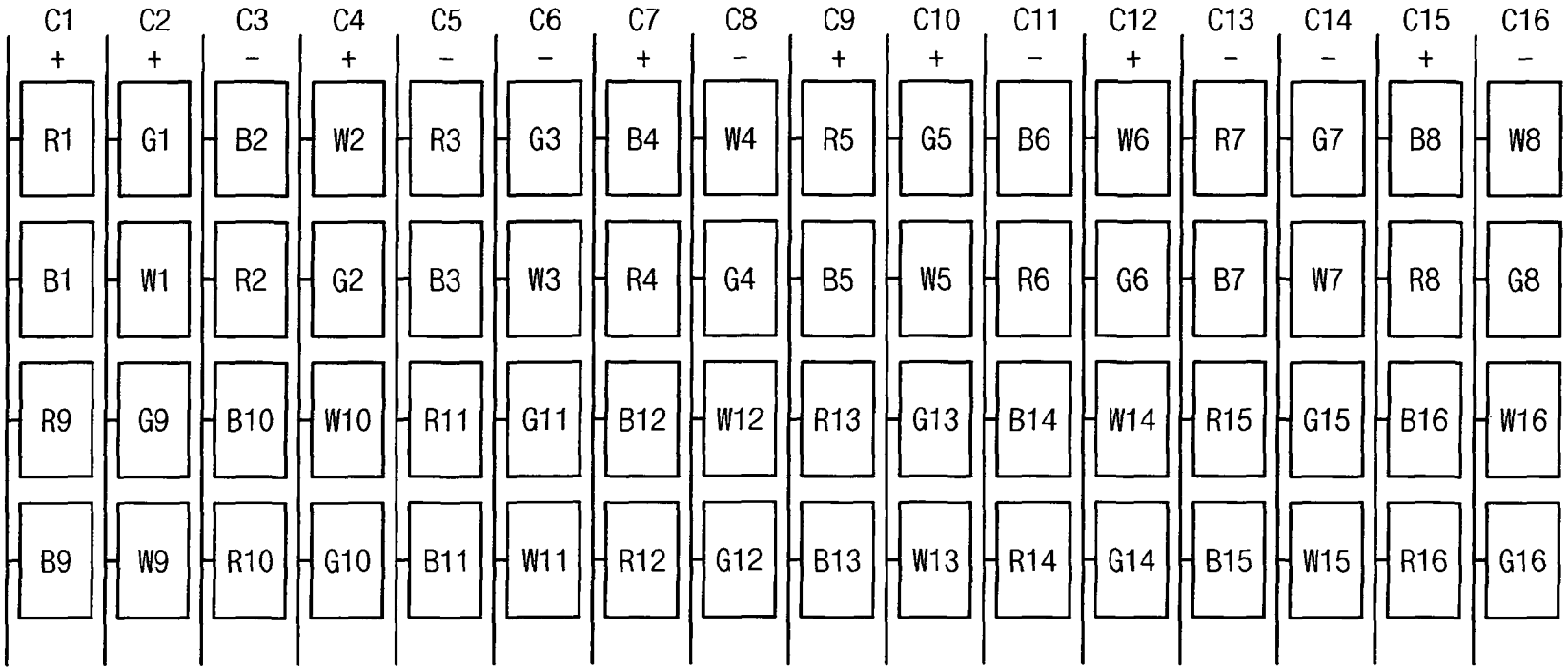
FIG. 3A is a plan view illustrating polarities of pixel voltages applied to the display panel of FIG. 2 in an N-th frame.
Figure 3B:
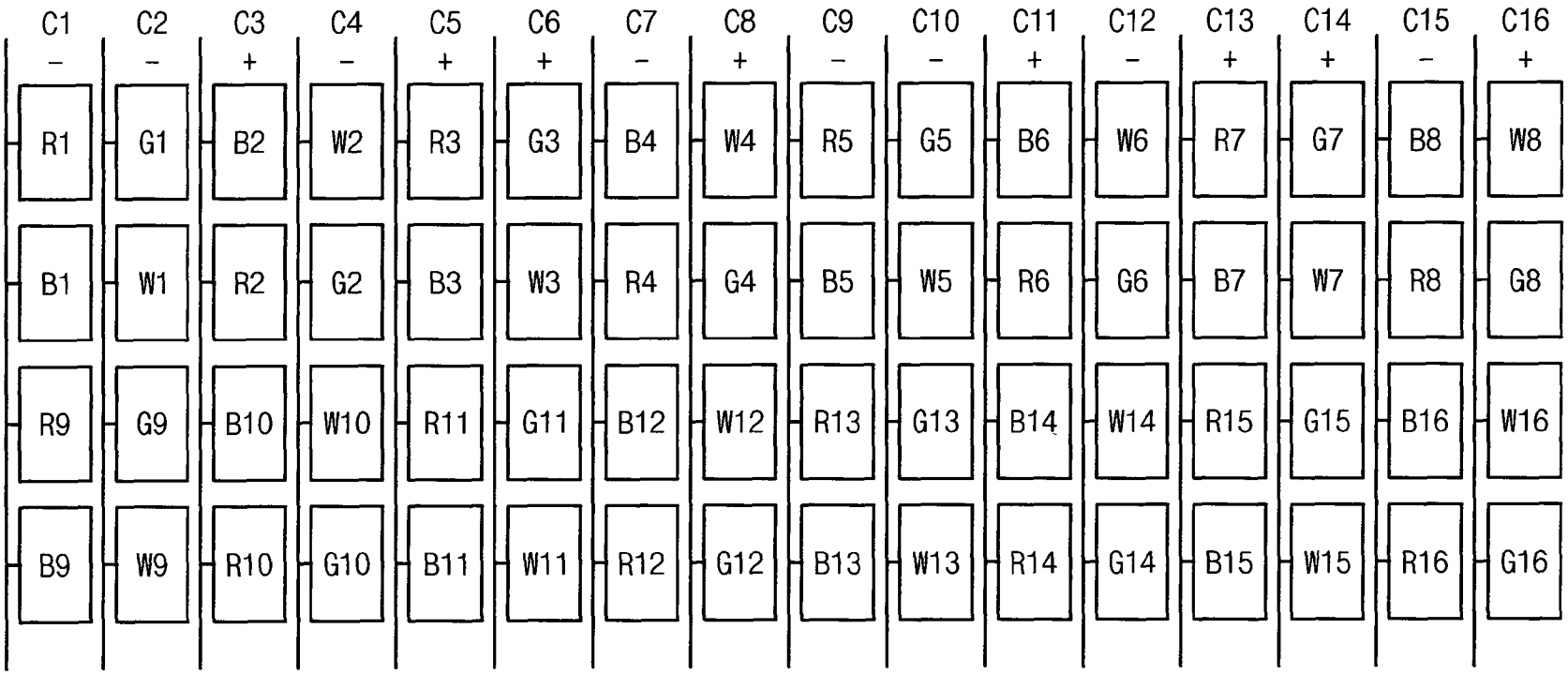
FIG. 3B is a plan view illustrating polarities of pixel voltages applied to the display panel of FIG. 2 in an (N+1)-th frame.
Figure 4:
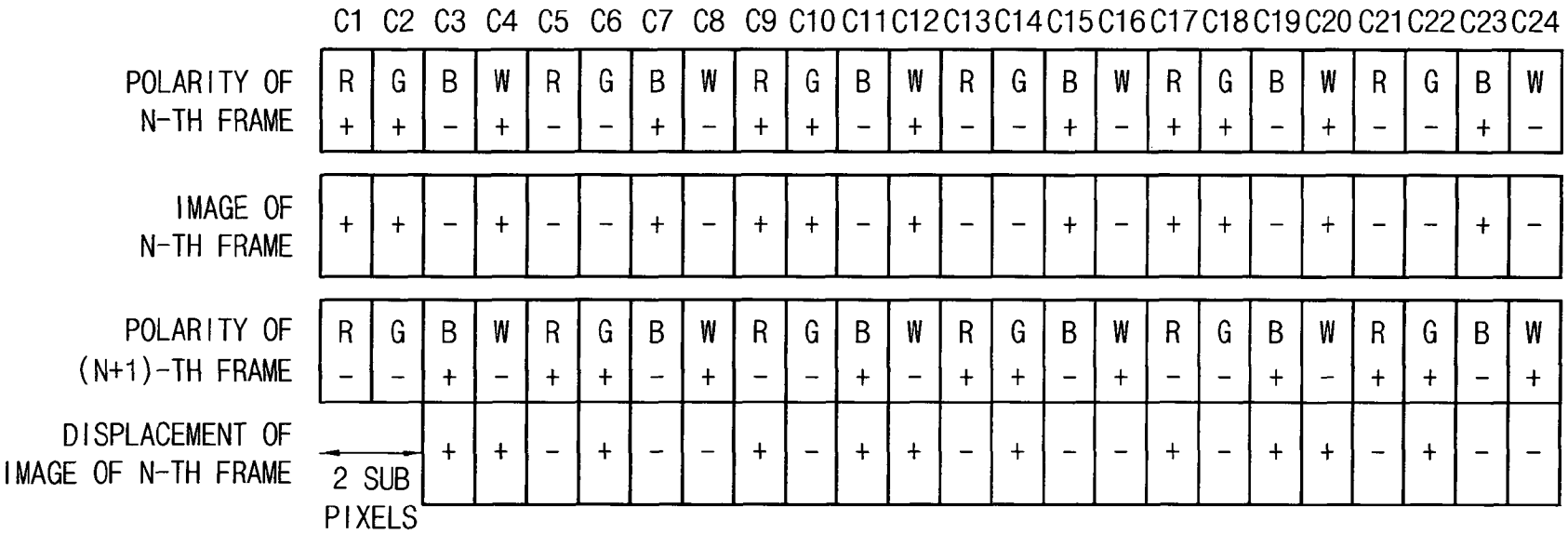
FIG. 4 is a conceptual diagram illustrating a polarity characteristic of an image displayed on the display panel of FIG. 2 when the image of the N-th frame displaces by two subpixels in a horizontal direction in the (N+1)-th frame.
Figure 5:
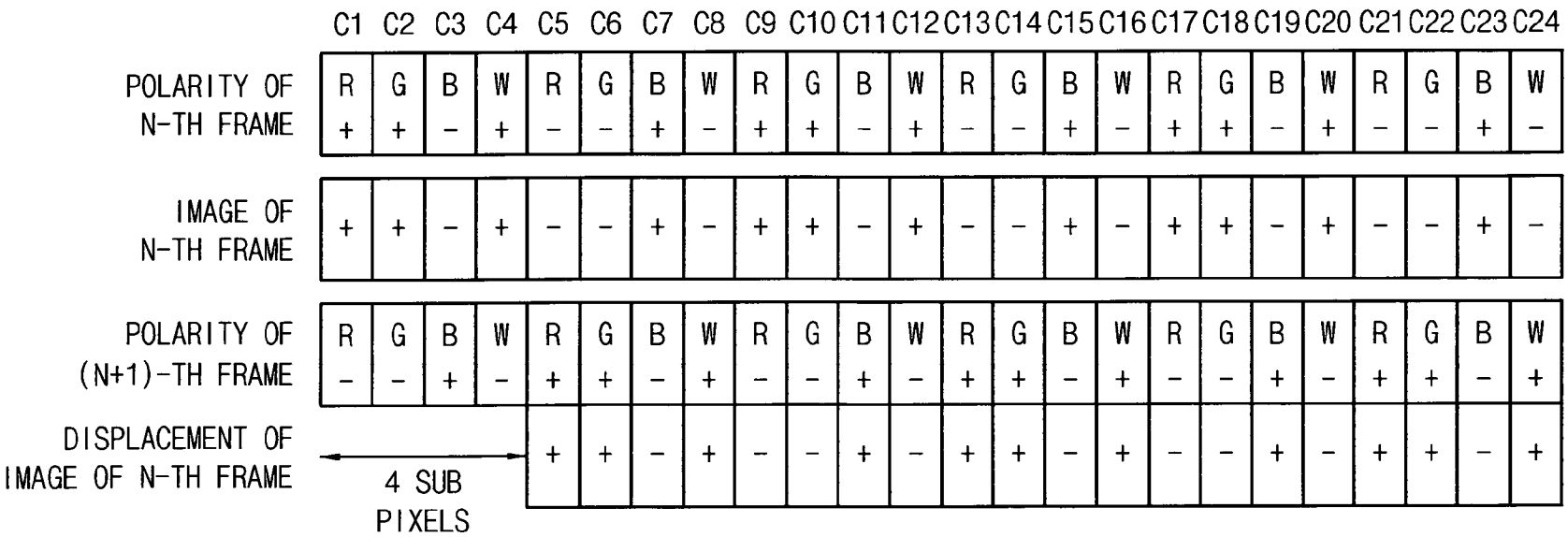
FIG. 5 is a conceptual diagram illustrating a polarity characteristic of an image displayed on the display panel of FIG. 2 when the image of the N-th frame displaces by four subpixels in the horizontal direction in the (N+1)-th frame.

FIG. 3A is a plan view illustrating polarities of pixel voltages applied to the display panel of FIG. 2 in an N-th frame. FIG. 3B is a plan view illustrating polarities of pixel voltages applied to the display panel of FIG. 2 in an (N+1)-th frame. FIG. 4 is a conceptual diagram illustrating a polarity characteristic of an image displayed on the display panel of FIG. 2 when the image of the N-th frame displaces by two subpixels in a horizontal direction in the (N+1)-th frame. FIG. 5 is a conceptual diagram illustrating a polarity characteristic of an image displayed on the display panel of FIG.

2 when the image of the N-th frame displaces by four subpixels in the horizontal direction in the (N+1)-th frame. Herein, N is a natural number.

Referring to FIGS. 1 to 5, the polarities of the subpixels of the display panel 100 may be inverted in every frame. In the N-th frame, a first set of pixel voltages which includes positive pixel voltages (+) and negative pixel voltages (−) is applied to the subpixels of the display panel 100. In the (N+1)-th frame, a second set of pixel voltages having polarities opposite to the polarities of the first set of the pixel voltages is applied to the subpixels of the display panel 100. The data driver 500 applies the first set of the pixel voltages and the second set of pixel voltages to the display panel 100.

The subpixels in the pixel column are connected to the same data line. For example, the subpixels in a first pixel column C1 are connected to a first data line, the subpixels in a second pixel column C2 are connected to a second data line, the subpixels in a third pixel column C3 are connected to a third data line, and the subpixels in a fourth pixel column C4 are connected to a fourth data line. In each frame, pixel voltages having the same polarity are applied to the subpixels in the same pixel column of the display panel 100.

In the N-th frame, the polarities of the pixel voltages corresponding to the first to eighth pixel columns C1 to C8 may be sequentially +, +, −, +, −, −, +, −. In addition, the polarities of the pixel voltages corresponding to the ninth to sixteenth pixel columns C9 to C16 may be sequentially +, +, −, +, −, −, +, −. In addition, the polarities of the pixel voltages corresponding to the seventeenth to twenty fourth pixel columns C17 to C24 may be sequentially +, +, −, +, −, −, +, −.

In the (N+1)-th frame, the polarities of the pixel voltages corresponding to the first to eighth pixel columns C1 to C8 may be sequentially −, −, +, −, +, +, −, +. In addition, the polarities of the pixel voltages corresponding to the ninth to sixteenth pixel columns C9 to C16 may be sequentially −, −, +, −, +, +, −, +. In addition, the polarities of the pixel voltages corresponding to the seventeenth to twenty fourth pixel columns C17 to C24 may be sequentially −, −, +, −, +, +, −, +.

In FIG. 4, the image displayed on the display panel 100 in the N-th frame displaces in the horizontal direction by two subpixels in the (N+1)-th frame.

The polarities of the pixel voltages in the N-th frame are sequentially +, +, −, +, −, −, +, −. In contrast, the polarities of the pixel voltages in the (N+1)-th frame are sequentially −, −, +, −, +, +, −, +.

As shown in third pixel column C3 in FIG. 4, the image of the N-th frame corresponding to the first pixel column C1 has the positive polarity (+) and the polarity of the (N+1)-th frame also has the positive polarity (+) so that the image of the third pixel column C3 in the (N+1)-th frame represents a relatively high luminance.

As shown in fourth pixel column C4 in FIG. 4, the image of the N-th frame corresponding to the second pixel column C2 has the positive polarity (+) but the polarity of the (N+1)-th frame has the negative polarity (−) so that the image of the fourth pixel column C4 in the (N+1)-th frame represents a normal luminance because the positive polarity (+) of the image of the N-th frame and the negative polarity (−) of the (N+1)-th frame are countervailed.

As shown in fifth pixel column C5 in FIG. 4, the image of the N-th frame corresponding to the third pixel column C3 has the negative polarity (−) but the polarity of the (N+1)-th frame has the positive polarity (+) so that the image of the fifth pixel column C5 in the (N+1)-th frame represents a normal luminance because the negative polarity (−) of the image of the N-th frame and the positive polarity (+) of the (N+1)-th frame are countervailed.

As shown in sixth pixel column C6 in FIG. 4, the image of the N-th frame corresponding to the fourth pixel column C4 has the positive polarity (+) and the polarity of the (N+1)-th frame also has the positive polarity (+) so that the image of the sixth pixel column C6 in the (N+1)-th frame represents a relatively high luminance.

As shown in seventh pixel column C7 in FIG. 4, the image of the N-th frame corresponding to the fifth pixel column C5 has the negative polarity (−) and the polarity of the (N+1)-th frame also has the negative polarity (−) so that the image of the seventh pixel column C7 in the (N+1)-th frame represents a relatively low luminance.

As shown in eighth pixel column C8 in FIG. 4, the image of the N-th frame corresponding to the sixth pixel column C6 has the negative polarity (−) but the polarity of the (N+1)-th frame has the positive polarity (+) so that the image of the eighth pixel column C8 in the (N+1)-th frame represents a normal luminance because the negative polarity (−) of the image of the N-th frame and the positive polarity (+) of the (N+1)-th frame are countervailed.

As shown in ninth pixel column C9 in FIG. 4, the image of the N-th frame corresponding to the seventh pixel column C7 has the positive polarity (+) but the polarity of the (N+1)-th frame has the negative polarity (−) so that the image of the ninth pixel column C9 in the (N+1)-th frame represents a normal luminance because the positive polarity (+) of the image of the N-th frame and the negative polarity (−) of the (N+1)-th frame are countervailed.

As shown in tenth pixel column C10 in FIG. 4, the image of the N-th frame corresponding to the eighth pixel column C8 has the negative polarity (−) and the polarity of the (N+1)-th frame also has the negative polarity (−) so that the image of the tenth pixel column C10 in the (N+1)-th frame represents a relatively low luminance.

Therefore, when the image displayed on the display panel 100 in the N-th frame displaces in the horizontal direction by two subpixels in the (N+1)-th frame, the second, seventh, tenth and fifteenth pixel columns C2, C7, C10 and C15 represent relatively low luminances but the third, sixth, eleventh and fourteenth pixel columns C3, C6, C11 and C14 represent relatively high luminances.

In general, when the image displayed on the display panel 100 in the N-th frame displaces in the horizontal direction by two subpixels in the (N+1)-th frame, (8M+2)-th and (8M+7)-th pixel columns represent relatively low luminances and (8M+3)-th and (8M+6)-th pixel columns represent relatively high luminances. Herein, M is a natural number equal to or greater than zero.

In FIG. 5, the image displayed on the display panel 100 in the N-th frame displaces in the horizontal direction by four subpixels in the (N+1)-th frame.

The polarities of the pixel voltages in the N-th frame are sequentially +, +, −, +, −, −, +, −. In contrast, the polarities of the pixel voltages in the (N+1)-th frame are sequentially −, −, +, −, +, +, −, +.

As shown in fifth pixel column C5 in FIG. 5, the image of the N-th frame corresponding to the first pixel column C1 has the positive polarity (+) and the polarity of the (N+1)-th frame also has the positive polarity (+) so that the image of the fifth pixel column C5 in the (N+1)-th frame represents a relatively high luminance.

In a similar manner, the images of the sixth, eighth and eleventh pixel columns C6, C8 and C11 in the (N+1)-th frame represent relatively high luminances.

As shown in seventh pixel column C7 in FIG. 5, the image of the N-th frame corresponding to the third pixel column C3 has the negative polarity (−) and the polarity of the (N+1)-th frame also has the negative polarity (−) so that the image of the seventh pixel column C7 in the (N+1)-th frame represents a relatively low luminance.

In a similar manner, the images of the ninth, tenth and twelfth pixel columns C9, C10 and C12 in the (N+1)-th frame represent relatively low luminances.

Therefore, when the image displayed on the display panel 100 in the N-th frame displaces in the horizontal direction by four subpixels in the (N+1)-th frame, the first, second, fourth, seventh, ninth, tenth, twelfth and fifteenth pixel columns C1, C2, C4, C7, C9, C10, C12 and C15 represent relatively low luminances but the third, fifth, sixth, eighth, eleventh, thirteenth, fourteenth and sixteenth pixel columns C3, C5, C6, C8, C11, C13, C14 and C16 represent relatively high luminances.

In general, when the image displayed on the display panel 100 in the N-th frame displaces in the horizontal direction by four subpixels in the (N+1)-th frame, (8M+1)-th, (8M+2)-th, (8M+4)-th and (8M+7)-th pixel columns represent relatively low luminances and (8M+3)-th, (8M+5)-th, (8M+6)-th and (8M+8)-th pixel columns represent relatively high luminances.

A negative compensating value may be applied to the pixel voltages of the pixel column having a relatively high luminance to decrease the luminance. A positive compensating value may be applied to the pixel voltages of the pixel column having a relatively low luminance to increase the luminance.

The timing controller 200 may apply the positive compensating value and the negative compensating value to the data signal, and may output the compensated data signal to the data driver 500. Thus, the data driver 500 may output the pixel voltage, to which the positive compensating value and the negative compensating value are applied, to the display panel 100.

In an exemplary embodiment, the compensating values may be generally applied to the pixel voltages of the display panel 100 without detecting a displacing pattern of the image according to frames.

For example, the negative compensating value may be applied to the pixel voltages of the third pixel column C3 and the sixth pixel column C6 to decrease the luminance because the third pixel column C3 and the sixth pixel column C6 commonly represent relatively high luminances in the case of the image displayed on the display panel 100 in the N-th frame displacing in the horizontal direction by two subpixels in the (N+1)-th frame as shown in FIG. 4 and in the case of the image displayed on the display panel 100 in the N-th frame displacing in the horizontal direction by four subpixels in the (N+1)-th frame as shown in FIG. 5. The positive compensating value may be applied to the pixel voltages of the second pixel column C2 and the seventh pixel column C7 to increase the luminance because the second pixel column C2 and the seventh pixel column C7 commonly represent relatively low luminances in the case of the image displayed on the display panel 100 in the N-th frame displacing in the horizontal direction by two subpixels in the (N+1)-th frame as shown in FIG. 4 and in the case of the image displayed on the display panel 100 in the N-th frame displacing in the horizontal direction by four subpixels in the (N+1)-th frame as shown in FIG. 5.

The compensating value 'a' may be determined to be between 0 and a difference 'b' of the positive pixel luminance and the negative pixel luminance. For example, the compensating value 'a' may be half of the difference 'b' of the positive pixel luminance and the negative pixel luminance. The compensating value 'a' may be an absolute value. The positive compensating value may be +a and the negative compensating value may be −a.

When the compensating values are generally applied to the pixel voltages of the display panel 100 without detecting a displacing pattern of the image according to frames, the timing controller 200 does not detect the pattern of the frame images so that a load of the timing controller 200 and a memory may not increase.

In an exemplary embodiment, the compensating values may be applied to the pixel voltages of the display panel 100 when a predetermined displacing pattern of the image according to frames is detected. When the image on the display panel 100 in the N-th frame does not displace in the (N+1)-th frame, the compensating values are not applied to all of the pixel voltages.

In contrast, when the image on the display panel 100 in the N-th frame displaces in the (N+1)-th frame, the negative compensating values are applied to the pixel voltages of the third pixel column C3 and the sixth pixel column C6 to decrease the luminance and the positive compensating values are applied to the pixel voltages of the second pixel column C2 and the seventh pixel column C7 to increase the luminance.

The compensating value a may be determined to be between 0 and a difference b of the positive pixel luminance and the negative pixel luminance. For example, the compensating value a may be half of the difference b of the positive pixel luminance and the negative pixel luminance. The compensating value a may be an absolute value. The positive compensating value may be +a and the negative compensating value may be −a.

In an exemplary embodiment, the compensating values may be applied to the pixel voltages of the display panel 100 when a predetermined displacing pattern of the image according to frames is detected. When the image on the display panel 100 in the N-th frame does not displace in the (N+1)-th frame, the compensating values are not applied to all of the pixel voltages. In addition, when the image on the display panel 100 in the N-th frame displaces in the (N+1)-th frame by odd numbered subpixels, the compensating values are not applied to all of the pixel voltages.

In contrast, when the image on the display panel 100 in the N-th frame displaces in the (N+1)-th frame by even numbered subpixels, the negative compensating values are applied to the pixel voltages of the third pixel column C3 and the sixth pixel column C6 to decrease the luminance, and the positive compensating values are applied to the pixel voltages of the second pixel column C2 and the seventh pixel column C7 to increase the luminance.

The compensating value a may be determined to be between 0 and a difference b of the positive pixel luminance and the negative pixel luminance. The compensating value a may be an absolute value. The positive compensating value may be +a and the negative compensating value may be −a.

In an exemplary embodiment, the compensating values may be applied to the pixel voltages of the display panel 100 when a predetermined displacing pattern of the image according to frames is detected. When the image on the display panel 100 in the N-th frame does not displace in the (N+1)-th frame, the compensating values are not applied to all of the pixel voltages. In addition, when the image on the display panel 100 in the N-th frame displaces in the (N+1)-th frame by odd numbered subpixels, the compensating values are not applied to all of the pixel voltages.

In contrast, when the image on the display panel 100 in the N-th frame displaces in the (N+1)-th frame by two subpixels, the negative compensating values are applied to the pixel voltages of the third pixel column C3 and the sixth pixel column C6 to decrease the luminance, and the positive compensating values are applied to the pixel voltages of the second pixel column C2 and the seventh pixel column C7 to increase the luminance.

In addition, when the image on the display panel 100 in the N-th frame displaces in the (N+1)-th frame by four subpixels, the negative compensating values are applied to the pixel voltages of the third pixel column C3, the fifth pixel column C5, the sixth pixel column C6 and the eighth pixel column C8 to decrease the luminance, and the positive compensating values are applied to the pixel voltages of the first pixel column C1, the second pixel column C2, the fourth pixel column C4 and the seventh pixel column C7 to increase the luminance.

The compensating value a may be determined to be between 0 and a difference b of the positive pixel luminance and the negative pixel luminance. The compensating value a may be an absolute value. The positive compensating value may be +a and the negative compensating value may be −a.

If the compensating value is selectively applied to the pixel voltage when the displacing pattern of the image is detected, the display defect generated by applying the compensating value when the image does not displace may be prevented. Thus, the display quality of the display panel 100 may be further improved.

A memory for detecting the displacing pattern of the image may be less than a frame memory. For example, when the data signals corresponding to odd numbered gate lines are used to detect the displacing pattern, the memory for detecting the displacing pattern of the image may be a half frame memory. In addition, when the data signals corresponding to 3n gate lines are used to detect the displacing pattern, the memory for detecting the displacing pattern of the image may be a ⅓ frame memory.

According to the present exemplary embodiment, the negative compensating values are applied to the pixel column representing a relatively high luminance and the positive compensating values are applied to the pixel column representing a relatively low luminance in the display panel 100 which is driven in the inversion driving method. Thus, when an image displaces on the display panel 100 in a direction, the vertical line defect may be prevented so that the display quality of the display panel 100 may be improved.

Figure 6A:
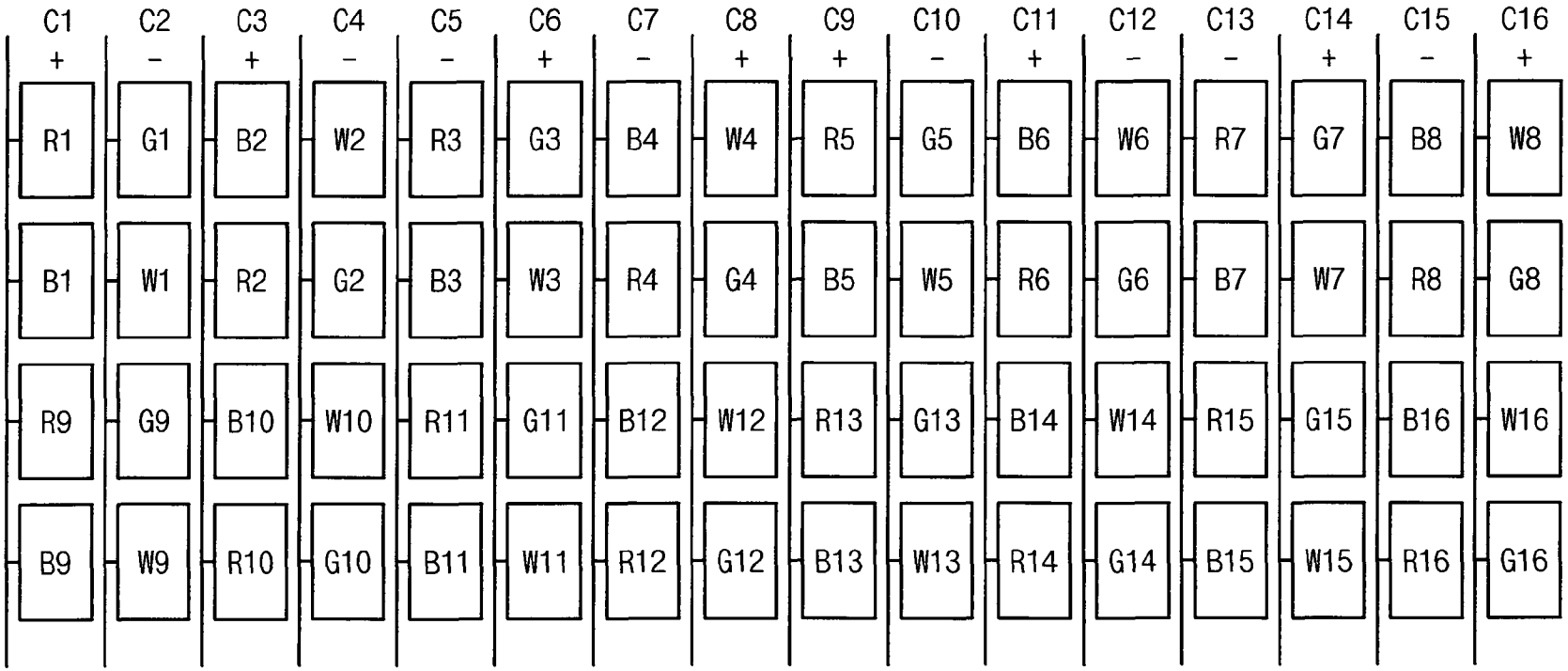
FIG. 6A is a plan view illustrating polarities of pixel voltages applied to a display panel according to an exemplary embodiment of the present invention in an N-th frame.
Figure 6B:
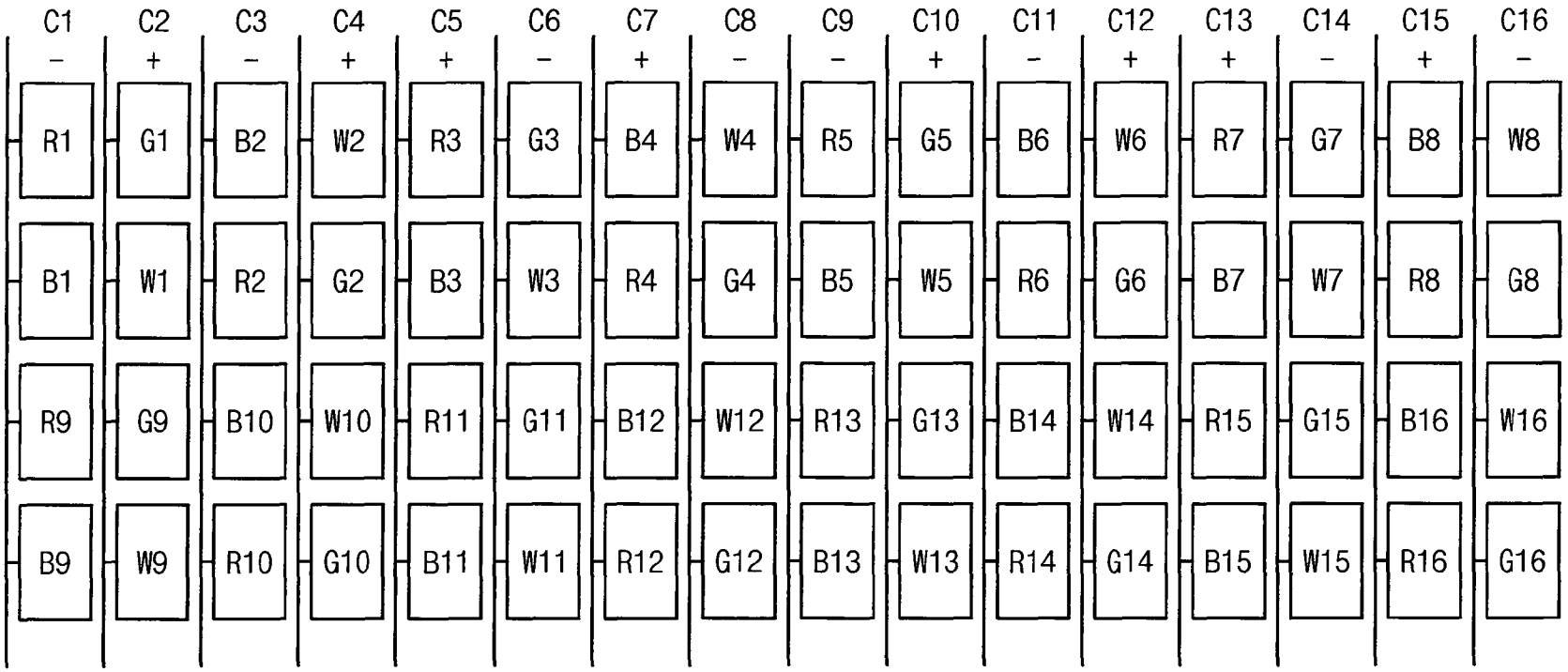
FIG. 6B is a plan view illustrating polarities of pixel voltages applied to the display panel of FIG. 6A in an (N+1)-th frame.
Figure 7:
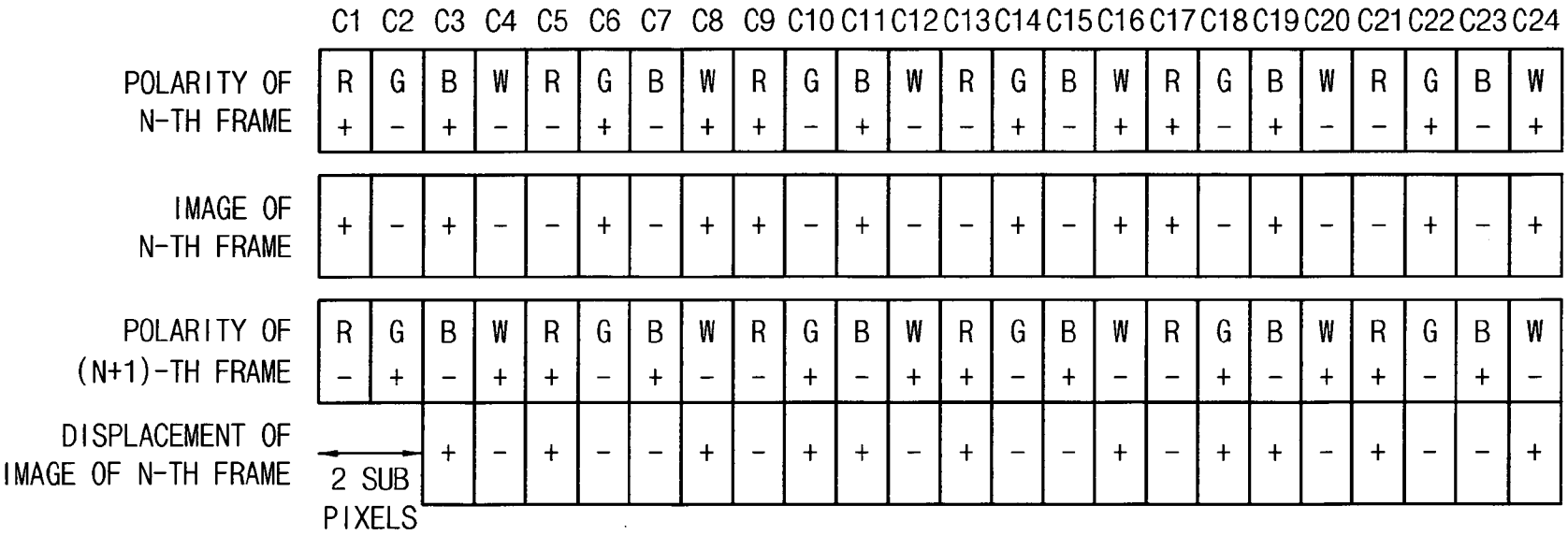
FIG. 7 is a conceptual diagram illustrating a polarity characteristic of an image displayed on the display panel of FIG. 6A when the image of the N-th frame displaces by two subpixels in a horizontal direction in the (N+1)-th frame.
Figure 8:
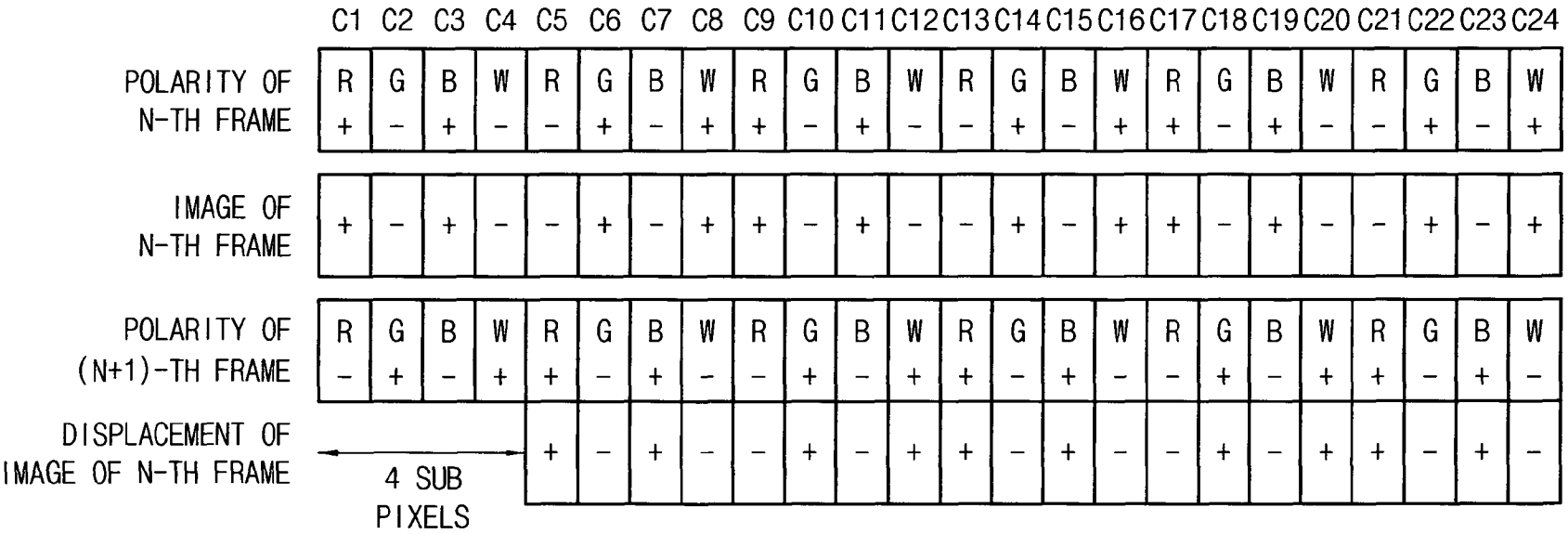
FIG. 8 is a conceptual diagram illustrating a polarity characteristic of an image displayed on the display panel of FIG. 6A when the image of the N-th frame displaces by four subpixels in the horizontal direction in the (N+1)-th frame.

FIG. 6A is a plan view illustrating polarities of pixel voltages applied to a display panel according to an exemplary embodiment of the present invention in an N-th frame. FIG. 6B is a plan view illustrating polarities of pixel voltages applied to the display panel of FIG. 6A in an (N+1)-th frame. FIG. 7 is a conceptual diagram illustrating a polarity characteristic of an image displayed on the display panel of FIG. 6A when the image of the N-th frame displaces by two subpixels in a horizontal direction in the (N+1)-th frame. FIG. 8 is a conceptual diagram illustrating a polarity characteristic of an image displayed on the display panel of FIG. 6A when the image of the N-th frame displaces by four subpixels in the horizontal direction in the (N+1)-th frame.

The display apparatus according to the present exemplary embodiment is substantially the same as the display apparatus of the previous exemplary embodiment explained with reference to FIGS. 1 to 5 except for an inversion driving method of the display panel. Thus, the same reference numerals will be used to refer to the same or like parts as those described in the previous exemplary embodiment of FIGS. 1 to 5, and any repetitive explanation concerning the above elements will be omitted.

Referring to FIGS. 1, 2, 6A to 8, the display apparatus includes a display panel 100 and a panel driver. The panel driver includes a timing controller 200, a gate driver 300, a gamma reference voltage generator 400 and a data driver 500.

The polarities of the subpixels of the display panel 100 may be inverted in every frame. In the N-th frame, a first set of pixel voltages which includes positive pixel voltages (+) and negative pixel voltages (−) is applied to the subpixels of the display panel 100. In the (N+1)-th frame, a second set of pixel voltages having polarities opposite to the polarities of the first set of the pixel voltages is applied to the subpixels of the display panel 100. The data driver 500 applies the first set of the pixel voltages and the second set of the pixel voltages to the display panel 100.

In the N-th frame, the polarities of the pixel voltages corresponding to the first to eighth pixel columns C1 to C8 may be sequentially +, −, +, −, −, +, −, +. In addition, the polarities of the pixel voltages corresponding to the ninth to sixteenth pixel columns C9 to C16 may be sequentially +, −, +, −, −, +, −, +. In addition, the polarities of the pixel voltages corresponding to the seventeenth to twenty fourth pixel columns C17 to C24 may be sequentially +, −, +, −, −, +, −, +.

In the (N+1)-th frame, the polarities of the pixel voltages corresponding to the first to eighth pixel columns C1 to C8 may be sequentially −, +, −, +, +, −, +, −. In addition, the polarities of the pixel voltages corresponding to the ninth to sixteenth pixel columns C9 to C16 may be sequentially −, +, −, +, +, −, +, −. In addition, the polarities of the pixel voltages corresponding to the seventeenth to twenty fourth pixel columns C17 to C24 may be sequentially −, +, −, +, +, −, +, −.

In FIG. 7, the image displayed on the display panel 100 in the N-th frame displaces in the horizontal direction by two subpixels in the (N+1)-th frame.

The polarities of the pixel voltages in the N-th frame are sequentially +, −, +, −, −, +, −, +. In contrast, the polarities of the pixel voltages in the (N+1)-th frame are sequentially −, +, −, +, +, −+, −.

As shown in fifth pixel column C5 in FIG. 7, the image of the N-th frame corresponding to the third pixel column C3 has the positive polarity (+) and the polarity of the (N+1)-th frame also has the positive polarity (+) so that the image of the fifth pixel column C5 in the (N+1)-th frame represents a relatively high luminance.

In a similar manner, the images of the tenth and thirteenth pixel columns C10 and C13 in the (N+1)-th frame represent relatively high luminances.

As shown in sixth pixel column C6 in FIG. 7, the image of the N-th frame corresponding to the fourth pixel column C4 has the negative polarity (−) and the polarity of the (N+1)-th frame also has the negative polarity (−) so that the image of the sixth pixel column C6 in the (N+1)-th frame represents a relatively low luminance.

In a similar manner, the images of the tenth and thirteenth pixel columns C9 and C14 in the (N+1)-th frame represent relatively high luminances.

Therefore, when the image displayed on the display panel 100 in the N-th frame displaces in the horizontal direction by two subpixels in the (N+1)-th frame, the second, fifth, tenth and thirteenth pixel columns C2, C5, C10 and C13 represent relatively high luminances but the first, sixth, ninth and fourteenth pixel columns C1, C6, C9 and C14 represent relatively low luminances.

In general, when the image displayed on the display panel 100 in the N-th frame displaces in the horizontal direction by two subpixels in the (N+1)-th frame, (8M+2)-th and (8M+5)-th pixel columns represent relatively high luminances and (8M+1)-th and (8M+6)-th pixel columns represent relatively low luminances. Herein, M is a natural number equal to or greater than zero.

In FIG. 8, the image displayed on the display panel 100 in the N-th frame displaces in the horizontal direction by four subpixels in the (N+1)-th frame.

The polarities of the pixel voltages in the N-th frame are sequentially +, −, +, −, −, +, −, +. In contrast, the polarities of the pixel voltages in the (N+1)-th frame are sequentially −, +, −, +, +, −, +, −.

As shown in fifth pixel column C5 in FIG. 8, the image of the N-th frame corresponding to the first pixel column C1 has the positive polarity (+) and the polarity of the (N+1)-th frame also has the positive polarity (+) so that the image of the fifth pixel column C5 in the (N+1)-th frame represents a relatively high luminance.

In a similar manner, the images of the seventh, tenth and twelfth pixel columns C7, C10 and C12 in the (N+1)-th frame represent relatively high luminances.

As shown in sixth pixel column C6 in FIG. 8, the image of the N-th frame corresponding to the second pixel column C2 has the negative polarity (−) and the polarity of the (N+1)-th frame also has the negative polarity (−) so that the image of the sixth pixel column C6 in the (N+1)-th frame represents a relatively low luminance.

In a similar manner, the images of the eighth, ninth and eleventh pixel columns C8, C9 and C11 in the (N+1)-th frame represent relatively low luminances.

Therefore, when the image displayed on the display panel 100 in the N-th frame displaces in the horizontal direction by four subpixels in the (N+1)-th frame, the first, third, sixth, eighth, ninth, eleventh, fourteenth and sixteenth pixel columns C1, C3, C6, C8, C9, C11, C14 and C16 represent relatively low luminances but the second, fourth, fifth, seventh, tenth, twelfth, thirteenth and fifteenth pixel columns C2, C4, C5, C7, C10, C12, C13 and C15 represent relatively high luminances.

In general, when the image displayed on the display panel 100 in the N-th frame displaces in the horizontal direction by four subpixels in the (N+1)-th frame, (8M+1)-th, (8M+3)-th, (8M+6)-th and (8M+8)-th pixel columns represent relatively low luminances and (8M+2)-th, (8M+4)-th, (8M+5)-th and (8M+7)-th pixel columns represent relatively high luminances.

A negative compensating value may be applied to the pixel voltages of the pixel column having a relatively high luminance to decrease the luminance. A positive compensating value may be applied to the pixel voltages of the pixel column having a relatively low luminance to increase the luminance.

In an exemplary embodiment, the compensating values may be generally applied to the pixel voltages of the display panel 100 without detecting a displacing pattern of the image according to frames.

For example, the negative compensating value may be applied to the pixel voltages of the second pixel column C2 and the fifth pixel column C5 to decrease the luminance because the second pixel column C2 and the fifth pixel column C5 commonly represent relatively high luminances in the case of the image displayed on the display panel 100 in the N-th frame displacing in the horizontal direction by two subpixels in the (N+1)-th frame as shown in FIG. 7 and in the case of the image displayed on the display panel 100 in the N-th frame displacing in the horizontal direction by four subpixels in the (N+1)-th frame as shown in FIG. 8. The positive compensating value may be applied to the pixel voltages of the first pixel column C1 and the sixth pixel column C6 to increase the luminance because the first pixel column C1 and the sixth pixel column C6 commonly represent relatively low luminances in the case of the image displayed on the display panel 100 in the N-th frame displacing in the horizontal direction by two subpixels in the (N+1)-th frame as shown in FIG. 7, and in the case of the image displayed on the display panel 100 in the N-th frame displacing in the horizontal direction by four subpixels in the (N+1)-th frame as shown in FIG. 8.

When the compensating values are generally applied to the pixel voltages of the display panel 100 without detecting a displacing pattern of the image according to frames, the timing controller 200 does not detect the pattern of the frame images so that a load of the timing controller 200 and a memory may not increase.

In an exemplary embodiment, the compensating values may be applied to the pixel voltages of the display panel 100 when a predetermined displacing pattern of the image according to frames is detected. When the image on the display panel 100 in the N-th frame does not displace in the (N+1)-th frame, the compensating values are not applied to all of the pixel voltages.

In contrast, when the image on the display panel 100 in the N-th frame displaces in the (N+1)-th frame, the negative compensating values are applied to the pixel voltages of the second pixel column C2 and the fifth pixel column C5 to decrease the luminance, and the positive compensating values are applied to the pixel voltages of the first pixel column C1 and the sixth pixel column C6 to increase the luminance.

In an exemplary embodiment, the compensating values may be applied to the pixel voltages of the display panel 100 when a predetermined displacing pattern of the image according to frames is detected. When the image on the display panel 100 in the N-th frame does not displace in the (N+1)-th frame, the compensating values are not applied to all of the pixel voltages. In addition, when the image on the display panel 100 in the N-th frame displaces in the (N+1)-th frame by odd numbered subpixels, the compensating values are not applied to all of the pixel voltages.

In contrast, when the image on the display panel 100 in the N-th frame displaces in the (N+1)-th frame by even numbered subpixels, the negative compensating values are applied to the pixel voltages of the second pixel column C2 and the fifth pixel column C5 to decrease the luminance, and the positive compensating values are applied to the pixel voltages of the first pixel column C1 and the sixth pixel column C6 to increase the luminance.

In an exemplary embodiment, the compensating values may be applied to the pixel voltages of the display panel 100 when a predetermined displacing pattern of the image according to frames is detected. When the image on the display panel 100 in the N-th frame does not displace in the (N+1)-th frame, the compensating values are not applied to all of the pixel voltages. In addition, when the image on the display panel 100 in the N-th frame displaces in the (N+1)-th frame by odd numbered subpixels, the compensating values are not applied to all of the pixel voltages.

In contrast, when the image on the display panel 100 in the N-th frame displaces in the (N+1)-th frame by two subpixels, the negative compensating values are applied to the pixel voltages of the second pixel column C2 and the fifth pixel column C5 to decrease the luminance and the positive compensating values are applied to the pixel voltages of the first pixel column C1 and the sixth pixel column C6 to increase the luminance.

In addition, when the image on the display panel 100 in the N-th frame displaces in the (N+1)-th frame by four subpixels, the negative compensating values are applied to the pixel voltages of the second pixel column C2, the fourth pixel column C4, the fifth pixel column C5 and the seventh pixel column C7 to decrease the luminance, and the positive compensating values are applied to the pixel voltages of the first pixel column C1, the third pixel column C3, the sixth pixel column C6 and the eighth pixel column C8 to increase the luminance.

If the compensating value is selectively applied to the pixel voltage when the displacing pattern of the image is detected, the display defect generated by applying the compensating value when the image does not displace may be prevented. Thus, the display quality of the display panel 100 may be further improved.

According to the present exemplary embodiment, the negative compensating values are applied to the pixel column representing a relatively high luminance and the positive compensating values are applied to the pixel column representing a relatively low luminance in the display panel 100 which is driven in the inversion driving method. Thus, when an image displaces on the display panel 100 in a direction, the vertical line defect may be prevented so that the display quality of the display panel 100 may be improved.

According to the present invention as explained above, the compensating values are varied for the respective data lines in the display panel which is driven in the inversion driving method. Thus, when an image displaces on the display panel in a direction, the vertical line defect may be prevented so that the display quality of the display panel may be improved.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function, and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, the method comprising the steps of:

applying a first set of pixel voltages, including a positive pixel voltage (+) and a negative pixel voltage (−), to subpixels of a display panel in an N-th frame;

applying a second set of pixel voltages, having polarities opposite to polarities of the first set of the pixel voltages, to the subpixels of the display panel in an (N+1)-th frame; and applying compensating values which are varied for respective data lines of the display panel according to a combination of a polarity of the pixel voltage corresponding to the data line in the N-th frame and a polarity of the pixel voltage corresponding to the data line in the (N+1)-th frame;

wherein N is a natural number;

wherein, when inversion driving of the display panel in the N-th frame displaces polarity in the (N+1)-th frame by X subpixels in a first direction, a first polarity of a first subpixel of the (N+1)-th frame and a second polarity of a second subpixel in the image of the N-th frame are determined, the second subpixel being spaced apart from the first subpixel by X subpixels in a second direction opposite to the first direction;

wherein, when both of the first polarity and the second polarity are positive (+), a negative compensating value is applied to the pixel voltage of the first pixel to decrease luminance in the (N+1)-th frame;

wherein, when both of the first polarity and the second polarity are negative (−), a positive compensating value is applied to the pixel voltage of the first pixel to increase the luminance in the (N+1)-th frame; and wherein X is a natural number.

2. The method of claim 1, wherein a first color subpixel, a second color subpixel, a third color subpixel and a fourth color subpixel are sequentially and repetitively disposed in a first pixel row of the display panel.

3. The method of claim 2, wherein the third color subpixel, the fourth color subpixel, the first color subpixel and the second color subpixel are sequentially and repetitively disposed in a second pixel row of the display panel.

4. The method of claim 2, wherein the first color subpixel, the second color subpixel and the third color subpixel are respectively a red subpixel, a green subpixel and a blue subpixel.

5. The method of claim 4, wherein the fourth color subpixel is a white subpixel.

6. The method of claim 1, wherein polarities of the pixel voltages corresponding to first to eighth pixel columns of the display panel are sequentially +, +, −, +, −, −, +, − in the N-th frame; and wherein the polarities of the pixel voltages corresponding to the first to eighth pixel columns of the display panel are sequentially −, −, +, −, +, +, −, + in the (N+1)-th frame.

7. The method of claim 6, wherein a negative compensating value is applied to the pixel voltages of the third and sixth pixel columns to decrease luminance; and wherein a positive compensating value is applied to the pixel voltages of the second and seventh pixel columns to increase the luminance.

8. The method of claim 6, wherein when inversion driving of the display panel in the N-th frame displaces polarity in the (N+1)-th frame by two subpixels, a negative compensating value is applied to the pixel voltages of the third and sixth pixel columns to decrease luminance in the (N+1)-th frame, and a positive compensating value is applied to the pixel voltages of the second and seventh pixel columns to increase the luminance in the (N+1)-th frame.

9. The method of claim 6, wherein when inversion driving of the display panel in the N-th frame displaces polarity in the (N+1)-th frame by four subpixels, a negative compensating value is applied to the pixel voltages of the third, fifth, sixth and eighth pixel columns to decrease luminance in the (N+1)-th frame, and a positive compensating value is applied to the pixel voltages of the first, second, fourth and seventh pixel columns to increase the luminance in the (N+1)-th frame.

10. The method of claim 1, wherein polarities of the pixel voltages corresponding to first to eighth pixel columns of the display panel are sequentially +, −, +, −, −, +, −, +in the N-th frame; and wherein the polarities of the pixel voltages corresponding to the first to eighth pixel columns of the display panel are sequentially −, +, −, +, +, −, +, − in the (N+1)-th frame.

11. The method of claim 10, wherein a negative compensating value is applied to the pixel voltages of the second and fifth pixel columns to decrease luminance, and a positive compensating value is applied to the pixel voltages of the first and sixth pixel columns to increase the luminance.

12. The method of claim 10, wherein when inversion driving of the display panel in the N-th frame displaces polarity in the (N+1)-th frame by two subpixels, a negative compensating value is applied to the pixel voltages of the second and fifth pixel columns to decrease luminance in the (N+1)-th frame, and a positive compensating value is applied to the pixel voltages of the first and sixth pixel columns to increase the luminance in the (N+1)-th frame.

13. The method of claim 10, wherein when inversion driving of the display panel in the N-th frame displaces polarity in the (N+1)-th frame by four subpixels, a negative compensating value is applied to the pixel voltages of the second, fourth, fifth and seventh pixel columns to decrease luminance in the (N+1)-th frame, and a positive compensating value is applied to the pixel voltages of the first, third, sixth and eighth pixel columns to increase the luminance in the (N+1)-th frame.

14. A display apparatus, comprising:

a display panel including a plurality of subpixels; and a data driver for applying a first set of pixel voltages, including a positive pixel voltage (+) and a negative pixel voltage (−), to the subpixels of the display panel in an N-th frame, for applying a second set of pixel voltages, having polarities opposite to polarities of the first set of the pixel voltages, to the subpixels of the display panel in an (N+1)-th frame, and for applying compensating values which are varied for respective data lines of the display panel according to both of a polarity of the pixel voltage corresponding to the data line in the N-th frame and a polarity of the pixel voltage corresponding to the data line in the (N+1)-th frame;

wherein N is a natural number;

wherein, when inversion driving of the display panel in the N-th frame displaces polarity in the (N+1)-th frame by X subpixels in a first direction, a first polarity of a first subpixel of the (N+1)-th frame and a second polarity of a second subpixel in the image of the N-th frame are determined, the second subpixel being spaced apart from the first subpixel by X subpixels in a second direction opposite to the first direction;

wherein, when both of the first polarity and the second polarity are positive (+), a negative compensating value is applied to the pixel voltage of the first pixel to decrease luminance in the (N+1)-th frame;

wherein, when both of the first polarity and the second polarity are negative (−), a positive compensating value is applied to the pixel voltage of the first pixel to increase the luminance in the (N+1)-th frame; and wherein X is a natural number.

15. The display apparatus of claim 14, wherein a first color subpixel, a second color subpixel, a third color subpixel and a fourth color subpixel are sequentially and repetitively disposed in a first pixel row of the display panel.

16. The display apparatus of claim 14, wherein polarities of the pixel voltages corresponding to first to eighth pixel columns of the display panel are sequentially +, +, −, +, −, −, +, −in the N-th frame; and wherein the polarities of the pixel voltages corresponding to the first to eighth pixel columns of the display panel are sequentially −, −, +, −, +, +, −, +in the (N+1)-th frame.

17. The display apparatus of claim 16, wherein a negative compensating value is applied to the pixel voltages of the third and sixth pixel columns to decrease luminance, and a positive compensating value is applied to the pixel voltages of the second and seventh pixel columns to increase the luminance.

18. The display apparatus of claim 14, wherein polarities of the pixel voltages corresponding to first to eighth pixel columns of the display panel are sequentially +, −, +, −, −, +, −, +in the N-th frame; and wherein the polarities of the pixel voltages corresponding to the first to eighth pixel columns of the display panel are sequentially −, +, −, +, +, −, +, − in the (N+1)-th frame.

19. The display apparatus of claim 18, wherein a negative compensating value is applied to the pixel voltages of the second and fifth pixel columns to decrease luminance, and a positive compensating value is applied to the pixel voltages of the first and sixth pixel columns to increase the luminance.

* * * * *